US012285844B2

(12) United States Patent
Sjöberg et al.

(10) Patent No.: US 12,285,844 B2
(45) Date of Patent: Apr. 29, 2025

(54) ABRADING WITH AN ABRADING PLATE

(71) Applicant: Mirka Ltd, Jepua (FI)

(72) Inventors: Tomas Sjöberg, Socklot (FI); Hans Hede, Vörå (FI); Maria Sundqvist, Vasa (FI); Mats Sundell, Hirvlax (FI)

(73) Assignee: MIRKA LTD, Jepua (FI)

( * ) Notice: Subject to any disclaimer, the term of this patent is extended or adjusted under 35 U.S.C. 154(b) by 890 days.

(21) Appl. No.: 17/058,672

(22) PCT Filed: Jun. 13, 2019

(86) PCT No.: PCT/FI2019/050456
§ 371 (c)(1),
(2) Date: Nov. 25, 2020

(87) PCT Pub. No.: WO2019/239013
PCT Pub. Date: Dec. 19, 2019

(65) Prior Publication Data

US 2021/0205958 A1 Jul. 8, 2021

(30) Foreign Application Priority Data

Jun. 15, 2018 (FI) ..... 20185541

(51) Int. Cl.
*B24D 13/14* (2006.01)
*B24B 7/24* (2006.01)
(Continued)

(52) U.S. Cl.
CPC ..... *B24D 13/147* (2013.01); *B24B 7/242* (2013.01); *B24B 23/02* (2013.01); *B24D 11/02* (2013.01)

(58) Field of Classification Search
CPC ..... B24D 13/147; B24D 11/02; B24D 3/06; B24D 3/08; B24D 3/10; B24B 7/242;
(Continued)

(56) References Cited

U.S. PATENT DOCUMENTS 5,888,119 A * 3/1999 Christianson ..... B24D 11/00 451/36
9,815,170 B2 * 11/2017 Eryu ..... H01L 21/02024
(Continued)

FOREIGN PATENT DOCUMENTS

CN 103659576 A * 3/2014 ..... B24B 37/12
CN 104924195 A 9/2015
(Continued)

OTHER PUBLICATIONS

Machine Translation of JP-2010064196-A (Year: 2010).*
(Continued)

*Primary Examiner* — Eric J Rosen
*Assistant Examiner* — Robert C Moore
(74) *Attorney, Agent, or Firm* — ArentFox Schiff LLP

(57) ABSTRACT

A method of abrading the surface of a workpiece is disclosed. The method includes providing a workpiece, an abrading apparatus with a backing pad configured to receive an abrading plate, an abrading plate attachable to the backing pad and a slurry including abrasive grains; attaching the abrading plate to the backing pad; providing the slurry including abrasive grains between the abrading plate and the surface of the workpiece; and operating the abrading apparatus to abrade the surface of the workpiece. Therein, the abrading plate includes a workpiece-facing layer, which workpiece-facing layer faces the surface of the workpiece and includes a metal or a polymer, and the abrasive grains have a hardness on the Mohs scale of greater than 5.

18 Claims, 8 Drawing Sheets

(51) Int. Cl.
*B24B 23/02* (2006.01)
*B24D 11/02* (2006.01)

(58) Field of Classification Search
CPC ..... B24B 23/02; B24B 37/12; B24B 37/14; B24B 37/16; B24B 41/002; B24B 41/0047
USPC ..... 451/36
See application file for complete search history.

(56) References Cited

U.S. PATENT DOCUMENTS

| | | | | |
|---|---|---|---|---|
| 2005/0075052 | A1 | 4/2005 | Kim et al. | |
| 2010/0203809 | A1* | 8/2010 | Kumasaka | C09K 3/1409 451/36 |
| 2010/0227532 | A1* | 9/2010 | Ishibashi | C30B 29/403 451/36 |
| 2013/0130595 | A1 | 5/2013 | Yoshida | |
| 2014/0206795 | A1* | 7/2014 | Bliss | B24B 29/02 523/205 |
| 2014/0273777 | A1 | 9/2014 | Lefevre et al. | |
| 2018/0311782 | A1* | 11/2018 | Tokushige | B24D 18/0027 |

FOREIGN PATENT DOCUMENTS

| | | | | | |
|---|---|---|---|---|---|
| EP | 1129821 | A1 | | 9/2001 | |
| EP | 3024015 | A1 | | 5/2016 | |
| EP | 3287234 | A1 | * | 2/2018 | B24B 1/00 |
| JP | 2000-87011 | A | | 3/2000 | |
| JP | 2004001169 | A | * | 1/2004 | B24B 37/24 |
| JP | 2010064196 | A | * | 3/2010 | |
| KR | 20070031220 | A | | 3/2007 | |
| KR | 20090010774 | A | * | 1/2009 | |
| KR | 2013-0140057 | A | | 12/2013 | |

OTHER PUBLICATIONS

Machine Translation of KR-20090010774-A (Year: 2009).*
Machine Translation of CN-103659576-A, (Year: 2014).*
Machine Translation of JP-2004001169-A (Year: 2004).*
Extended European Search Report mailed Feb. 18, 2022 issued in corresponding European Application No. 19819006.8.

* cited by examiner

ABRADING WITH AN ABRADING PLATE

PRIORITY

This application is a U.S. national application of the international application number PCT/FI2019/050456 filed on Jun. 13, 2019 and claiming priority of FI application Ser. No. 20/185,541 filed on Jun. 15, 2018 the contents of all of which are incorporated herein by reference.

FIELD

The solution relates to abrading with an abrasive plate, particularly to surface reconditioning and finishing of topcoats such as glass.

BACKGROUND

Abrading is typically performed to recondition and finish topcoats such as glass. Therein, the purpose typically is to remove defects such as surface height deviations, scratches and/or other surface imperfections from the abraded surface.

To obtain a completely finished topcoat, i.e. in general terms a completely finished surface of a workpiece, in many cases the finishing process comprises as major process stages first abrading the surface and thereafter polishing the surface. Such is typically the case to obtain a completely finished glass surface.

Currently, particularly in the case of glass surfaces such as hardened glass surfaces and especially in the case of chemically treated glass surfaces such as Gorilla™ glass or Dragontrail™ glass surfaces, abrading suffers from a number of deficiencies.

Namely, the abrading process is relatively slow, particularly in the case of hardened glass surfaces and especially in the case of chemically treated glass surfaces, as currently employed methods achieve relatively low rates of material removal from the workpiece surface.

Furthermore, with currently employed methods, particularly in the case of hardened glass surfaces and especially in the case of chemically treated glass surfaces, abrading produces an ununiform, scratched surface which is hard and time-consuming to polish into a completely finished, glossy surface and/or requires multiple abrading stages with progressively finer grits to yield a reasonably polishable surface.

Further still, currently employed methods require, particularly in the case of hardened glass surfaces and especially in the case of chemically treated glass surfaces, highly specialized abrasive articles which are difficult and time- and resource-consuming to manufacture.

It is an object of the presently disclosed solution to address such deficiencies.

SUMMARY OF THE DISCLOSED SOLUTION

The disclosed solution comprises a method of abrading the surface of a workpiece. The method comprises providing a workpiece, an abrading apparatus with a backing pad configured to receive an abrading plate, an abrading plate attachable to the backing pad and slurry comprising abrasive grains; attaching the abrading plate to the backing pad; providing the slurry comprising abrasive grains between the abrading plate and the surface of the workpiece; and operating the abrading apparatus to abrade the surface of the workpiece. Therein, the abrading plate comprises a workpiece-facing layer, which workpiece-facing layer faces the surface of the workpiece and comprises metal or polymer, and the abrasive grains have a hardness on the Mohs scale of greater than 5.

According to the disclosed solution, the abrading apparatus may be of the rotational type, of the random orbital type, or of the oscillating type.

According to the disclosed solution, the workpiece-facing layer of the abrading plate may comprise soft metal such as copper, zinc, brass or aluminum; or it may comprise a single polymer, a curable resin formulation, a blend of two or more polymers or a composite material.

According to the disclosed solution, the abrasive grains may comprise silicon carbide, aluminum oxide, boron carbide, cubic boron nitride, tungsten carbide, diamond, and zirconia.

According to the disclosed solution, the slurry may comprise water, abrasive grains, emulsifiers, wax, surface tension modifiers, oil, solvents, glycerin (propane1,2,3-triol) and/or viscosity modifiers.

According to the disclosed solution, the surface of the workpiece may comprise hardened glass and/or chemically treated glass such as Gorilla™ glass or Dragontrail™ glass.

One of the premises of the disclosed solution is that abrasive grains penetrate into the surface of the abrading plate such that part of the abrasive grains remain exposed, i.e. non-penetrated. Moreover, while being entrapped, abrasive grains may slightly budge, bringing about localized chipping of the surface of the workpiece.

As a result of the particular interaction of the abrasive grains with the surface of the abrading plate and the surface of the workpiece, the disclosed solution abrades the surface of the workpiece significantly more during the same abrading time than with conventional method.

As a further result of the particular interaction of the abrasive grains with the surface of the abrading plate and the surface of the workpiece, the disclosed solution produces a more uniform surface for the workpiece, devoid of distinctive scratches, than a conventional method. Therefore, the surface of the workpiece after treatment with the disclosed solution is easier to polish than after treatment with a conventional method.

As a further result of the particular interaction of the abrasive grains with the surface of the abrading plate and the surface of the workpiece, with the disclosed solution it is possible to use abundantly available and affordable abrasive grains such as silicon carbide grains. Moreover, such use of abundantly available and affordable abrasive grains is possible without a need to attach or fix the abrasive grains on the surface of an abrasive article before abrading.

It has been discovered that the disclosed solution is particularly effective with workpieces whose surface comprises or consists of hardened glass, and especially so if the surface of the workpiece comprises or consists of chemically treated glass such as Gorilla™ glass or Dragontrail™ glass. Such glass is commonly used in electronic devices such as mobile phones, smartphones, tablet computers, domestic appliances and automotive displays, and in touch screens in various other applications.

Therefore, the disclosed solution is particularly useful and effective for abrading a glass surface, such as a glass panel of an electronic device such as a mobile phone, smartphone or a tablet computer.

Thus, the disclosed solution is useful and effective for reconditioning a glass surface, particularly a hardened glass surface and especially a chemically treated glass surface, comprising scratches and/or defects. Therefore, the disclosed solution is useful and effective to recondition a glass panel of an electronic device, such as a second-hand mobile device, which glass panel comprises scratches and/or defects.

The figures are intended for illustrating the idea of the disclosed solution. Therefore, the figures are not necessarily in scale or suggestive of a definite layout of system components.

DETAILED DESCRIPTION OF THE INVENTION

Figure 1:
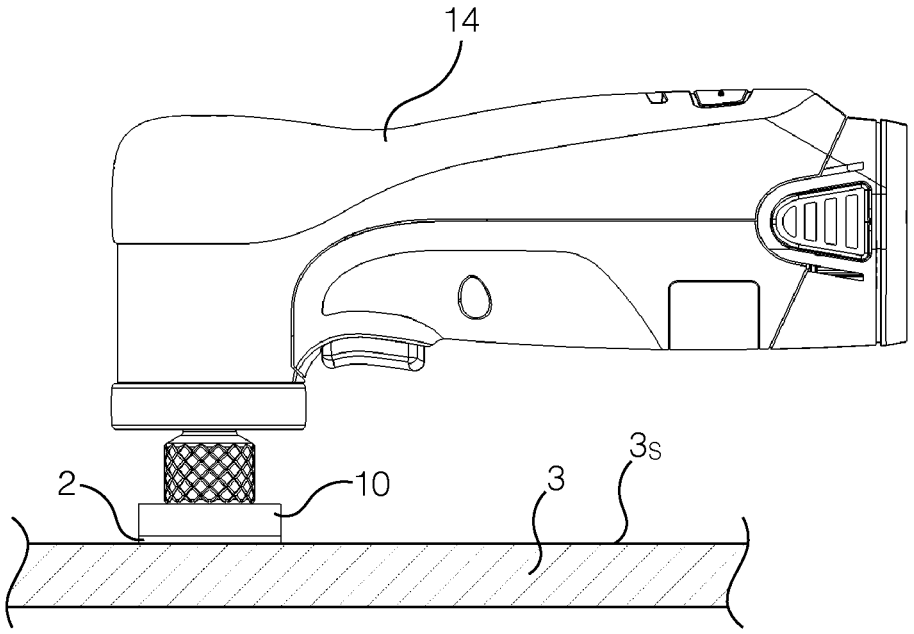
FIG. 1 schematically illustrates, according to an example, an abrading apparatus equipped with an abrasive tool comprising an abrading plate according to the disclosed solution, as viewed from a side.

In the text, reference is made to the figures with the following numerals and denotations:

1 Abrasive grain
2 Abrading plate
$\mathbf{2}_S$ Surface, of abrading plate
3 Workpiece
$\mathbf{3}_S$ Surface, of workpiece
4 Slurry
5 Abrasive tool
6 Pit
10 Backing pad
11 Backing layer, of backing pad
12 Attachment layer, of backing pad
13 Cushioning layer, of backing pad
14 Abrading apparatus
21 Workpiece-facing layer, of abrading plate
22 Attachment layer, of abrading plate
23 Backing layer, of abrading plate
$F_H$ Horizontal force
$F_V$ Vertical force
$h_1$ Height, of abrasive grain
$h_2$ Height, of abrading plate
$h_{21}$ Height, of workpiece-facing layer, of abrading plate
$h_{22}$ Height, of attachment layer, of abrading plate
$h_{23}$ Height, of backing layer, of abrading plate
$h_P$ Depth of penetration, of abrasive grain into abrading plate
X, Y, Z Orthogonal dimensions in the frame of abrading plate With reference to FIG. 1, the disclosed solution relates to abrading the surface $\mathbf{3}_S$ of a workpiece 3. According to the disclosed solution, such abrading is performed with an abrading apparatus 14, which may be of the rotational type, of the random orbital type or the oscillating type, to which abrading apparatus 14 is attached an abrading plate 2 via a backing pad 10 and also otherwise in accordance with what is described below.

It has been discovered that the disclosed solution is particularly effective with workpieces 3 which comprise or consist of, or at least whose surface $\mathbf{3}_S$ comprises or consists of, hardened glass, and especially so if the workpiece 3 comprises or consists of, or if at least its surface $\mathbf{3}_S$ comprises or consists of, chemically treated glass such as Gorilla™ glass or Dragontrail™ glass. Such glass is commonly used in electronic devices such as mobile phones, smartphones, tablet computers, domestic appliances and automotive displays, and in touch screens in various other applications.

Therefore, the disclosed solution is particularly useful and effective for abrading a glass surface, such as a glass panel of an electronic device such as a mobile phone, smartphone or a tablet computer.

Thus, the disclosed solution is useful and effective for reconditioning a glass surface, particularly a hardened glass surface and especially a chemically treated glass surface, comprising scratches and/or defects. Therefore, the disclosed solution is useful and effective to recondition a glass panel of an electronic device, such as a second-hand mobile device, which glass panel comprises scratches and/or defects.

After abrading the surface $\mathbf{3}_S$ of the workpiece 3 in accordance with the disclosed solution, the workpiece 3 may further be treated by, for example, polishing the abraded surface $\mathbf{3}_S$ of the workpiece 3. Such polishing may be carried out with a polishing device and a polishing slurry.

Figure 2:
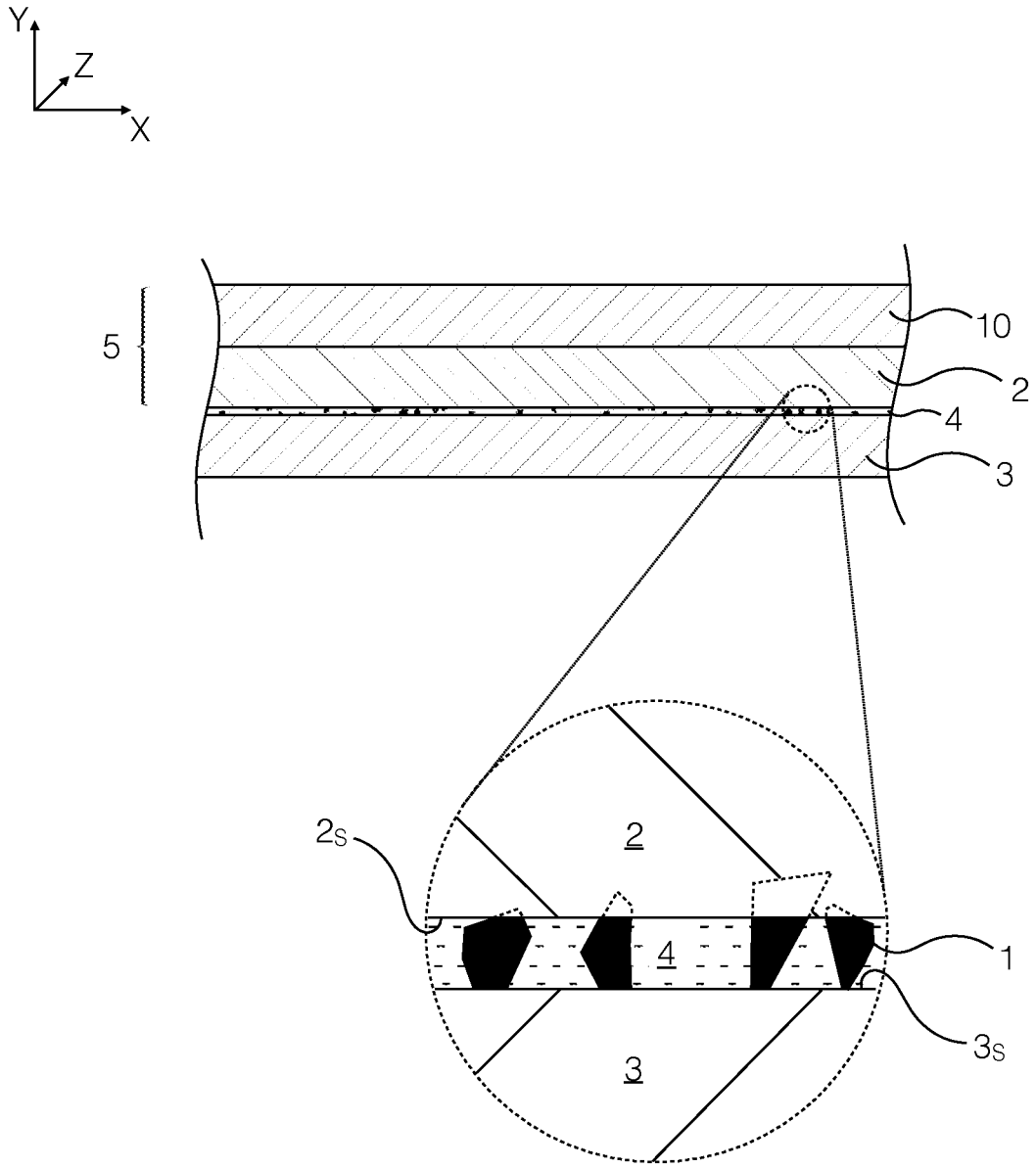
FIG. 2 schematically illustrates, according to an example, an abrasive tool comprising a backing pad and an abrading plate according to the disclosed solution, plus a workpiece and abrasive grains in a slurry, as viewed from a side.

Now referring to FIGS. 1 and 2, the disclosed solution comprises providing a workpiece 3, an abrading apparatus with a backing pad 10 configured to receive an abrading plate 2, an abrading plate 2 attachable to the backing pad 10 and slurry 4 comprising abrasive grains 1. For abrading the surface $3_S$ of a workpiece 3, the abrading plate 2 is attached to the backing pad 10, the slurry 4 comprising abrasive grains 1 is provided between the abrading plate 2 and the surface $3_S$ of the workpiece 3, whereafter the abrading apparatus 14 is operated to abrade the surface $3_S$ of the workpiece 3. According to the disclosed solution, and as elaborated more in detail below, the abrading plate 2 comprises a metal or polymer layer and the abrasive grains 1 have a hardness on the Moths scale of greater than 5.

Figure 4A:
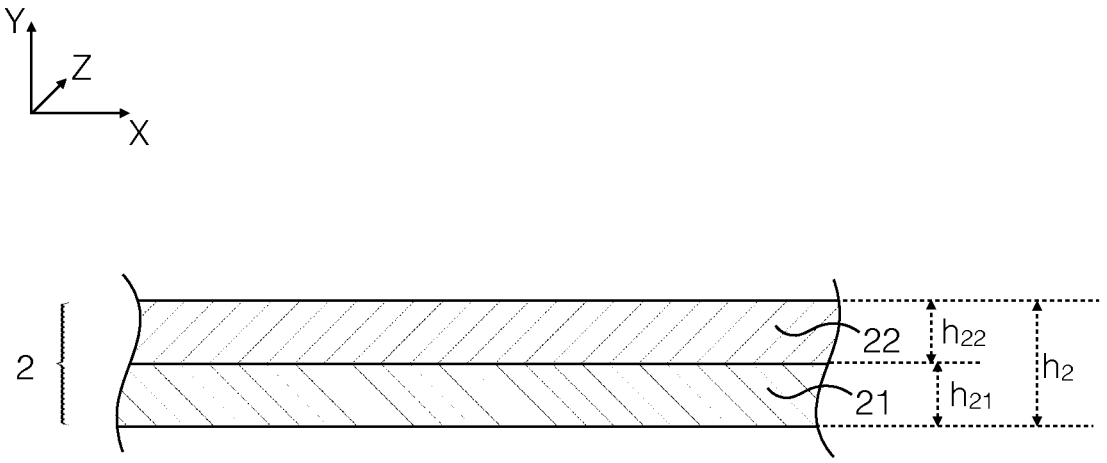
FIG. 4*a* schematically illustrates, according to an example, an abrading plate, as viewed from a side.
Figure 4B:
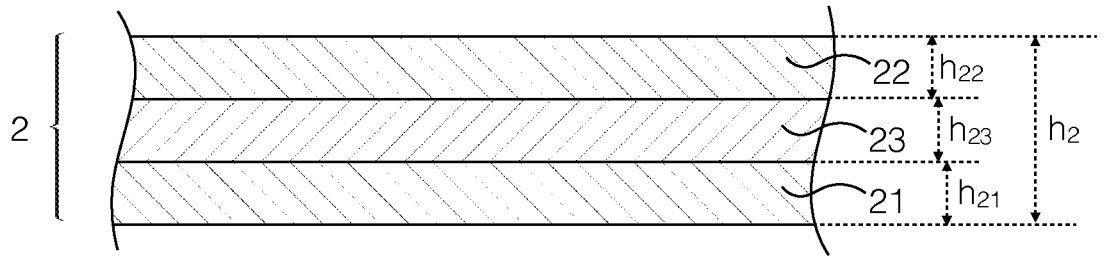
FIG. 4*b* schematically illustrates, according to another example, an abrading plate, as viewed from a side.

Now referring to FIGS. 4*a* and 4*b*, the abrading plate 2 according to the disclosed solution comprises a workpiece-facing layer 21, which faces the workpiece 3 during abrading, and an attachment layer 22 for attaching the abrading plate 2 to the backing pad 10.

The attachment layer 22 comprises means of attachment for attaching the abrading plate 2 to the backing pad 10. Such attachment elements may enable mechanical or adhesive attachment. Advantageously, such attachment enables removal and re-attachment. According to an example, such attachment elements comprise hook-and-loop type of fastening with the capability for convenient re-attachment. In an example, attachment layer 22 of the abrading plate 2 may comprise hooks and the attachment layer 12 of the backing pad 10 may comprise loops, or vice versa. According to another example, the means of attachment may be premised on pressure sensitive adhesion, i.e. PSA. In such an example, the attachment layer 22 of the abrading plate 2 may comprise pressure sensitive adhesive and the attachment layer 12 of the backing pad 10 may comprise an even surface adapted for pressure sensitive adhesion, or vice versa.

According to the disclosed solution, the workpiece-facing layer 21 of the abrading plate 2 comprises or consists of metal or polymer. The workpiece-facing layer 21 may have a height $h_{21}$ of 5 μm to 2 mm, such as 10-100 μm.

The composition of the workpiece-facing layer 21 is important for obtaining the desired results and technical effects of the disclosed solution because the properties of the workpiece-facing layer 21 significantly influences the dynamic interaction between the abrasive grains 1 and the surface $3_S$ of the workpiece 3, as will be described below more in detail. In particular, the abrasive grains 1 need to become entrapped within the lower surface $2_S$ of the abrading plate 2 in such a manner that the abrasive grains 1 may still slightly budge while being entrapped within the lower surface $2_S$ of the abrading plate, as will be described below more in detail.

In the case of the workpiece-facing layer 21 comprising or consisting of metal, such metal may be, for example, copper, zinc, brass or aluminum. According to an example, the workpiece-facing layer 21 consists of copper. According to a more specific example, the workpiece-facing layer 21 consists of copper and has a height $h_{21}$ of approximately 0.02-0.05 mm.

In the case of the workpiece-facing layer 21 comprising or consisting of polymer, such polymer may be, for example, a single polymer, a curable resin formulation, a blend of two or more polymers or a composite material. According to an example, the workpiece-facing layer 21 consists of polyurethane, epoxy, olefinic polymers or acrylate. According to a more specific example, the workpiece-facing layer 21 consists of polyurethane and has a height $h_{21}$ of approximately 0.25-1.00 mm.

In addition to the attachment layer 22 and the workpiece-facing layer 21, the abrading plate 2 may optionally comprise a backing layer 23, wherein the notion of "backing" refers to its function for backing and therefore supporting the workpiece-facing layer 21. With such a backing layer 23, the flexibility/rigidity and other dynamic properties of the abrading plate 2 may be controlled and adjusted along with bringing about a desired total height $h_2$ for the abrading plate 2.

Such a backing layer 23 may comprise or consist of, for example, cloth, foam or film. According to an example, the backing layer 23 comprises polyester film. According to a more specific example, the backing layer 23 comprises polyester film and has a height $h_{23}$ of approximately 50-150 μm.

Figure 5:
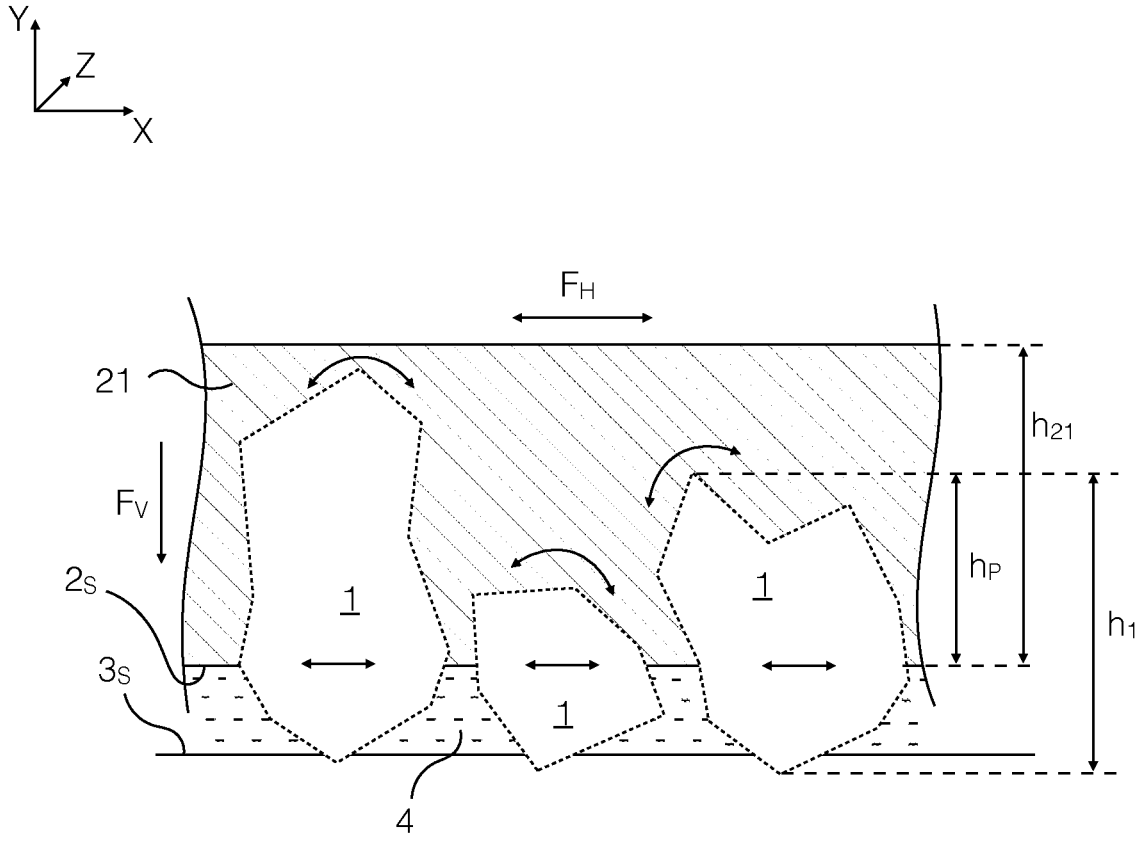
FIG. 5 schematically illustrates, according to an example, an abrading plate according to the disclosed solution plus abrasive grains in contact with a workpiece surface, as viewed from a side.

Now referring to FIG. 5, according to the disclosed solution, the abrasive grains 1 have a hardness on the Mohs scale of greater than 5. Such a hardness is conducive to obtaining desired abrading results in accordance with the disclosed solution, particularly in abrading glass, more particularly hardened glass and especially chemically treated glass such as Gorilla™ glass or Dragontrail™ glass.

Such abrasive grains 1 may comprise, for example, silicon carbide, aluminum oxide, boron carbide, cubic boron nitride, tungsten carbide, diamond, and/or zirconia. According to a specific example, abrasive grains 1 are silicon carbide grains.

Such abrasive grains 1 may have an average height $h_1$ of approximately 3-50 μm, wherein the height $h_1$ refers to the largest diameter of an abrasive grain 1. Preferably, the abrasive grains 1 have a narrow distribution in terms of their heights $h_1$.

However, because of the properties of the abrading plate 2 according to the disclosed solution, the disclosed solution has the benefit of being rather robust in terms of tolerating differences in the heights $h_1$ of the abrading grains 1. This is because the abrading grains may penetrate, as effected by the vertical force $F_V$ with which the abrading plate 2 is pressed against the workpiece 3, into differing depths of penetration $h_P$ into the workpiece-facing layer 21 of the abrading plate 2. That is, taller abrasive grains 1—known in the industry as 'carrier' grains—may penetrate deeper into the workpiece-facing layer 21 of the abrading plate 2 than grains with a smaller height $h_1$. Therefore, such taller 'carrier' grains do not cut appreciably deeper into the surface $3_S$ of the workpiece 3 during abrading, resulting in more uniform abraded surface $3_S$ of for the workpiece 3.

Now referring to FIG. 2, according to the disclosed solution, the abrasive particles 1 are to be introduced to the abrading process, i.e. between the abrading plate 2 and the surface $3_S$ of the workpiece 3 to be abraded, in slurry 4. In other words, for abrading the surface $3_S$ of the workpiece 3, slurry 4 comprising abrasive grains 1 is provided between the abrading plate 2 and the surface $3_S$ of the workpiece 3.

Such slurry 4 may comprise, for example, water, abrasive grains 1, emulsifiers, pH modifiers, wax, surface modifiers, oil, solvents, glycerin and/or viscosity modifiers. According to an example, the slurry 4 comprises grains 1, water, emulsifiers, wax, surface modifiers, oil, solvents, glycerin and viscosity modifiers such that the abrasive grains 1 account for 10-40% of the slurry 4 and the other, liquid components account for 90-60% of the slurry 4.

Figure 3A:
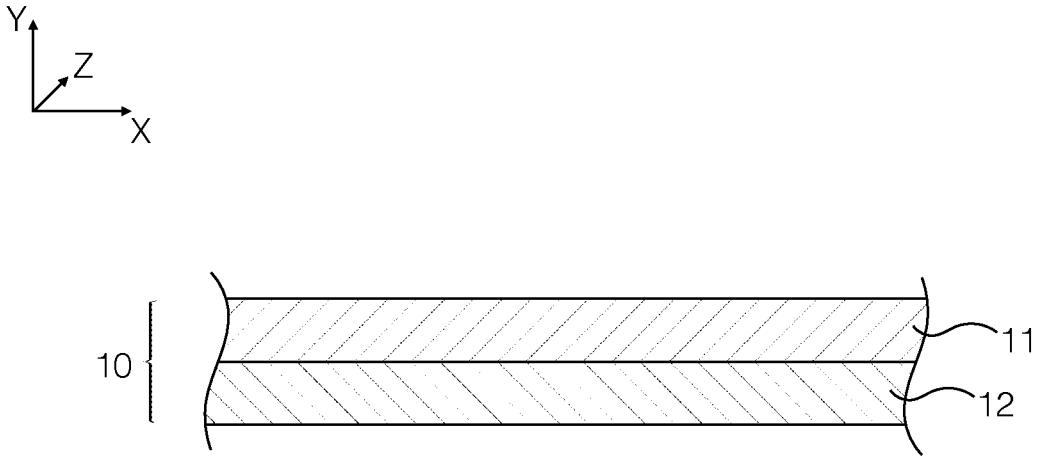
FIG. 3*a* schematically illustrates, according to an example, a backing pad, as viewed from a side.
Figure 3B:
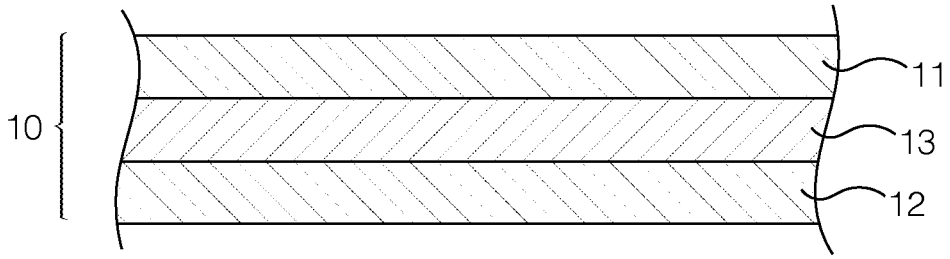
FIG. 3*b* schematically illustrates, according to another example, a backing pad, as viewed from a side.

Now referring to FIGS. 3*a* and 3*b*, the backing pad 10 comprises a backing layer 11 and an attachment layer 12. Optionally, the backing layer may additionally comprise a cushioning layer 13. According to the disclosed solution, during abrading a workpiece 3, the abrading plate 2 is to be attached to such a backing pad 10. Correspondingly, the backing pad 10 is to be attached to an abrading apparatus 14. It is to be appreciated that attaching a backing pad 10 to an abrading apparatus 14 is well known in the industry, and hence this issue will not be dealt with in detail here.

The backing layer 11 of the backing pad 10 is to provide structural support for the abrading plate 2 during abrading. Therefore, the backing pad 10 is preferably substantially flat, at least in terms of its surface facing the abrading plate 2. Furthermore, in the interest of its supporting function, preferably the backing pad 10 is sufficiently hard yet sufficiently flexible to allow application—appropriate conformity of the abrading plate 2 to the contours of the surface $\mathbf{3}_S$ of the workpiece 3—if in a certain application such conformity is desired.

According to an example, the backing pad 10 comprises rubber, polyurethane elastomer and latex and has a flexibility of 10-40 on the Shore A hardness scale.

The optional cushioning layer 13 of the backing pad 10 is to provide cushioning, such as dampening of impacts and vibration, between the abrading plate 2 and the abrading apparatus 14. The cushioning layer 13 of the backing pad may comprise a foamed polyurethane elastomer, foamed rubber, latex foam and/or polyurethane foam. According to an example, the cushioning layer 13 comprises a foamed polyurethane elastomer. According to another example, the cushioning layer 13 comprises foamed rubber.

The attachment layer 12 of the backing pad enables attaching the abrading plate 2 to the backing pad 10, in accordance with what has been described above. Thus, the by means of the attachment layer 12, the backing pad 10 comprises means of attachment for attaching the abrading plate 2 to the backing pad 10, namely to the attachment layer 12 of the backing pad 10.

Now referring to FIG. 1, according to the disclosed solution, abrading the surface $\mathbf{3}_S$ of a workpiece 3 is to be done with an abrading apparatus 14. Such an abrading apparatus may be of the rotational type, of the random orbital type, or of the oscillating type.

In case the abrading apparatus 14 is of the rotational type, the abrading plate 2—attached to the abrading apparatus 14 via the backing pad 10—undergoes circular motion about the vertical dimension, i.e. the Y dimension, around an axis of rotation. Hence—assuming for clarity of expression that the abrading apparatus 14 is not moved on X-Z plane—in the case the abrading apparatus 14 is of the rotational type, an abrasive particle 1 will travel, when entrapped within the surface $\mathbf{2}_S$ of the abrading plate 2, along a circular path with respect to the surface 3S of the workpiece 3.

In case the abrading apparatus 14 is of the oscillating type, the abrading plate 2—attached to the abrading apparatus 14 via the backing pad 10—undergoes oscillating motion on the X-Z plane. The direction(s) of oscillation on the X-Z plane depend on the direction(s) of oscillation effected by the abrading apparatus 14, which oscillating may be, for example, linear back-and-forth motion, and/or or orbital motion. Nonetheless—assuming for clarity of expression that the abrading apparatus 14 is not moved on X-Z plane—in the case the abrading apparatus 14 is of the oscillating type, an abrasive particle 1 will travel, when entrapped within the surface $\mathbf{2}_S$ of the abrading plate 2, along an oscillating path with respect to the surface $\mathbf{3}_S$ of the workpiece 3, wherein the oscillating path is in accordance with what is described immediately above. As is known in the industry, an oscillating-type abrading apparatus 14 has, as one of its characteristics, an oscillation amplitude or stroke (back-and-forth motion) or an oscillation diameter (orbital motion), plus an oscillation frequency in oscillations per minute. Typically, such oscillation amplitudes or diameters are in the range of 1-10 mm, and oscillation frequencies in the range of 1 000-18 000 oscillations per minute.

In the case the abrading apparatus 14 is of the random orbital type, the abrading plate 2—as attached to the abrading apparatus 14 via the backing pad 10 undergoes both oscillating orbital motion, as described above, as well as undergoes circular motion about the vertical dimension, i.e. the Y dimension, around an axis of rotation. Furthermore, and as is well known in the industry, typically the speed of rotation of the abrading plate 2 about its axis of rotation is dependent on the force with which the abrading plate 2—or more generally an abrading article 15—is pressed against the surface $\mathbf{3}_S$ of the workpiece 3. Moreover, this force may be temporally variable, especially in manually performed abrading. Hence—assuming for clarity of expression that the abrading apparatus 14 is not moved on X-Z plane—in the case the abrading apparatus 14 is of the random orbital type, an abrasive particle 1 will travel, when entrapped within the surface $\mathbf{2}_S$ of the abrading plate 2, along a random orbital path with respect to the surface $\mathbf{3}_S$ of the workpiece 3. Typically, random orbital abrading apparatuses 14 have oscillation diameters in the range of 1-10 mm, and oscillation frequencies in the range of 1 000-18 000 oscillations per minute, with abrading article rotation about its axis of rotation depending on abrading force but in a typical usage situation in the range of 0-1000 revolutions per minute.

Such an abrading apparatus 14 may be, for example, electrically powered, battery-powered or powered by compressed air.

Such an abrading apparatus 14 may be, for example, manually operated or robotically operated.

According to an example, the abrading apparatus 14 is battery-powered and manually operated. Such a configuration is advantageous for convenient abrading of small localized scratches or defects in large and/or immovably installed surfaces, such as large and/or immovably installed glass surfaces.

According to another example, the abrading apparatus 14 is electrically powered and robotically operated. Such a configuration is advantageous for efficient serialized abrading of small or relatively small glass surfaces such as glass panels of electronic devices. An example of such an application is industrial-scale reconditioning of mobile phone screens or other mobile phone glass panels.

In both of the above-mentioned examples, it is possible that only a portion of the total surface area of the surface $\mathbf{3}_S$ of the workpiece 3 may be abraded, with the rest of the total surface area of the surface $\mathbf{3}_S$ of the workpiece 3 left non-abraded. Such procedure is particularly beneficial when, for example, locally removing scratches from a larger workpiece 3 such as a glass panel, wherein there is no need to abrade the entire total surface area of the surface $\mathbf{3}_S$ of the workpiece 3.

FIG. 5 schematically illustrates localized dynamic behavior of abrading grains 1, in slurry 4, 15 with the surface $\mathbf{3}_S$ of the workpiece 3 and the abrading plate 2, which behavior is important for bringing about the technical effects and benefits of the disclosed solution.

Before abrading of the workpiece 3 begins—and if required during abrading—slurry 4 comprising abrasive grains 1, in accordance with what is described above, is provided between the abrading plate 2 and the surface $\mathbf{3}_S$ of the workpiece 3.

Because of the properties of the abrading plate 2 and the abrasive grains 1—in consistency with what is described above—once the abrading has begun, the abrasive grains 1 tend to become entrapped within the workpiece-facing layer 21 of the abrading plate 2, namely within the surface $2_S$ of the abrading plate 2, which surface $2_S$ faces the surface $3_S$ of the workpiece 3. Note that for illustrative clarity, in FIG. 5, only the workpiece-facing layer 21 of the abrading plate 2, and only the surface $3_S$ of the workpiece 3 are illustrated.

Furthermore, as an entrapment locus on the surface $2_S$ of the abrading plate 2 can entrap only one abrasive grain 1 at a time, loose abrasive grains 1 between the surface $2_S$ of the abrading plate 2 and the surface $3_S$ of the workpiece 3 tend to remain mobile until becoming entrapped within a vacant entrapment locus on the surface $2_S$ of the abrading plate 2. Therefore, according to the disclosed solution, the surface $2_S$ has, in practical terms, one layer of abrasive grains 1 in contact with the surface $3_S$ of the workpiece 3, enabling a high grain-specific abrading pressure against the surface $3_S$ of the workpiece 3.

Because of the properties of the abrading plate 2, and especially its workpiece-facing layer 21, and the abrasive grains 1—in consistency with what is described above—entrapment of abrasive grains 1 is such that:

- as effected by the vertical force $F_V$ with which the abrading plate 2 is pressed against the workpiece 3, the abrasive grains 1 penetrate into the surface $2_S$ of the abrading plate 2 such that part of the abrasive grains 1 remain exposed, i.e. non-penetrated, to the surface $3_S$ of the workpiece,
- taller 'carrier' abrasive grains 1—such as the leftmost schematically illustrated abrasive grain 1 in FIG. 5—with greater height $h_1$, in effect in this case greater vertical height $h_1$, penetrate deeper, i.e. have greater depth of penetration $h_P$ than smaller abrasive grains 1 because taller abrasive grains 1 experience higher grain-specific pressure until their exposed height is approximately equal to the average exposed height of all the other abrasive grains 1 between the abrading plate 1 and the surface $3_S$ of the workpiece 3,
- entrapped abrasive grains 1 may, while being entrapped, budge—as denoted with arrows in FIG. 5—i.e. move sideways on the X-Z plane and/or rotate within their general locus of entrapment, and
- some entrapped abrasive grains 1 may become loose from their locus of entrapment, travel for some time in between the surface $2_S$ of the abrading plate and the surface $3_S$ of the workpiece 3 before becoming entrapped again.

Figure 7A:
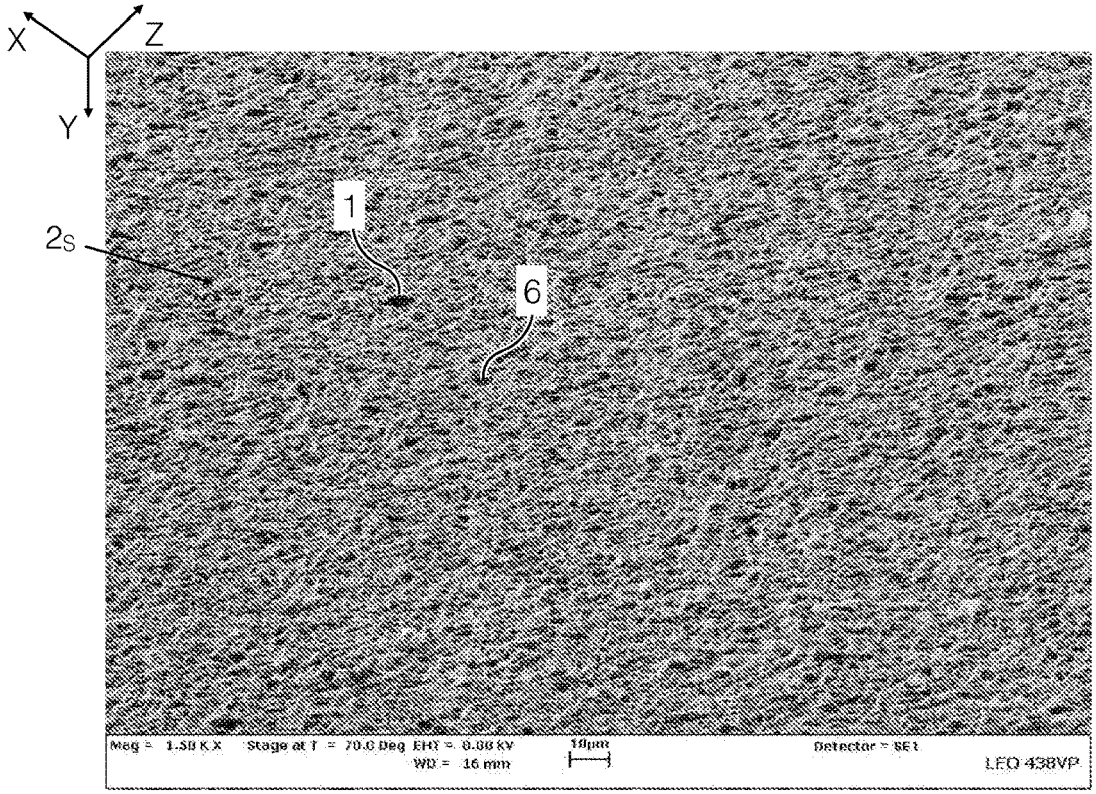
FIG. 7*a* illustrates, with a scanning electron microscope image, the surface of an abrading plate according to an example of the disclosed solution after 10 seconds of abrading a virgin glass surface, as viewed from diagonally above after turning the plate such that the abrading surface faces upwards.

FIG. 7*a* presents a scanning electron microscope (SEM) image of the surface $2_S$ of an abrading plate 2 according to the disclosed solution after 10 seconds of abrading a virgin glass surface, as viewed from diagonally above after turning the abrading plate 2 such that the abrading surface $2_S$ faces upwards. In this particular case illustrated in FIG. 7*a*, the workpiece-facing layer 21 of the abrading plate 2 is copper, the abrading apparatus 14 used for abrading is of the random orbital type and the glass surface is Dragontrail™ glass. As can be seen in the image, abrasive grains 1 have penetrate into the surface $2_S$ of the abrading plate 2 such that part of the abrasive grains 1 remain exposed, i.e. non-penetrated.

Figure 7B:
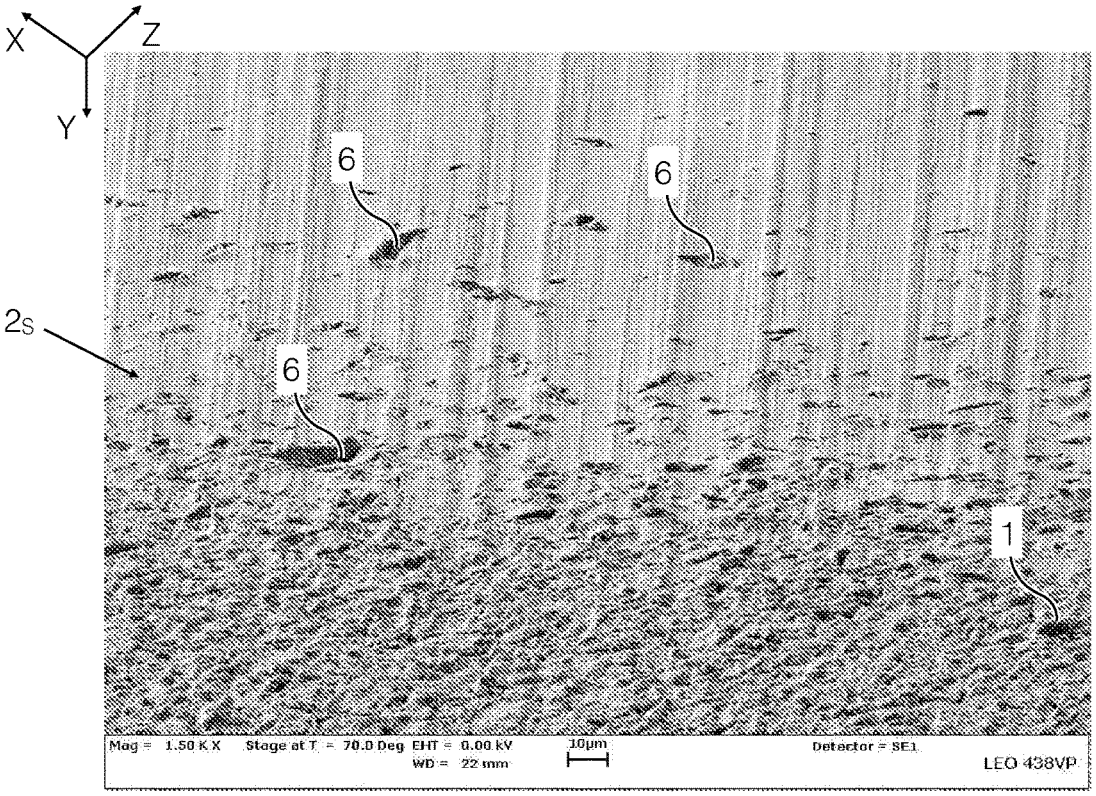
FIG. 7*b* illustrates, with a scanning electron microscope image and with greater magnification than in FIG. 7*a*, the surface of an abrading plate according to an example of the disclosed solution after 10 seconds of abrading a virgin glass surface, as viewed from diagonally above after turning the plate such that the abrading surface faces upwards. Therein, the uppermost shown region of the surface of the abrading plate has not been in contact with the surface of the workpiece whereas the lowermost shown region has been in such contact.

FIG. 7*b* presents a more greatly magnified scanning electron microscope (SEM) image of the surface $2_S$ of an abrading plate 2 according to the disclosed solution after 10 seconds of abrading a virgin hardened glass surface, as viewed from diagonally above after turning the abrading plate 2 such that the abrading surface $2_S$ faces upwards. In this particular case illustrated in FIG. 7*b*, the workpiece-facing layer 21 of the abrading plate 2 is copper, the abrading apparatus 14 used for abrading is of the random orbital type and the glass surface is Dragontrail™ glass. Specifically, in FIG. 7*b* is shown that portion of the surface $2_S$ of the abrading plate 2 in which the edge of the surface $3_S$ of the workpiece 3 has resided during abrading. Namely, as seen in FIG. 7*b*, the uppermost shown region of the abrading surface $2_S$ has not been in contact with the surface $3_S$ of the workpiece 3, whereas the lowermost shown region of the abrading surface $2_S$ has been in contact with the surface $3_S$ of the workpiece 3. In FIG. 7*b*, the shape and contours of pits 6 illustrate the rather plastic residence—relating to the phenomenon of budging as noted above—of the abrasive grains 1 in their general loci of entrapment, i.e. pits 6.

Especially because the entrapped abrasive grains 1 may, while being entrapped, slightly budge as described above, these entrapped abrasive grains 1 bring about localized chipping of the surface $3_S$ of the workpiece 3. This is because the abrasive grains 1, compared to abrasive articles in which abrasive grains are substantially rigidly attached to a substrate, engage in the disclosed solution substantially less in scratching-like interaction with the surface $3_S$ of the workpiece 3, and instead engage substantially more in pressing- and rolling-like—i.e. chipping—interaction with the surface $3_S$ of the workpiece 3.

Figure 6A:
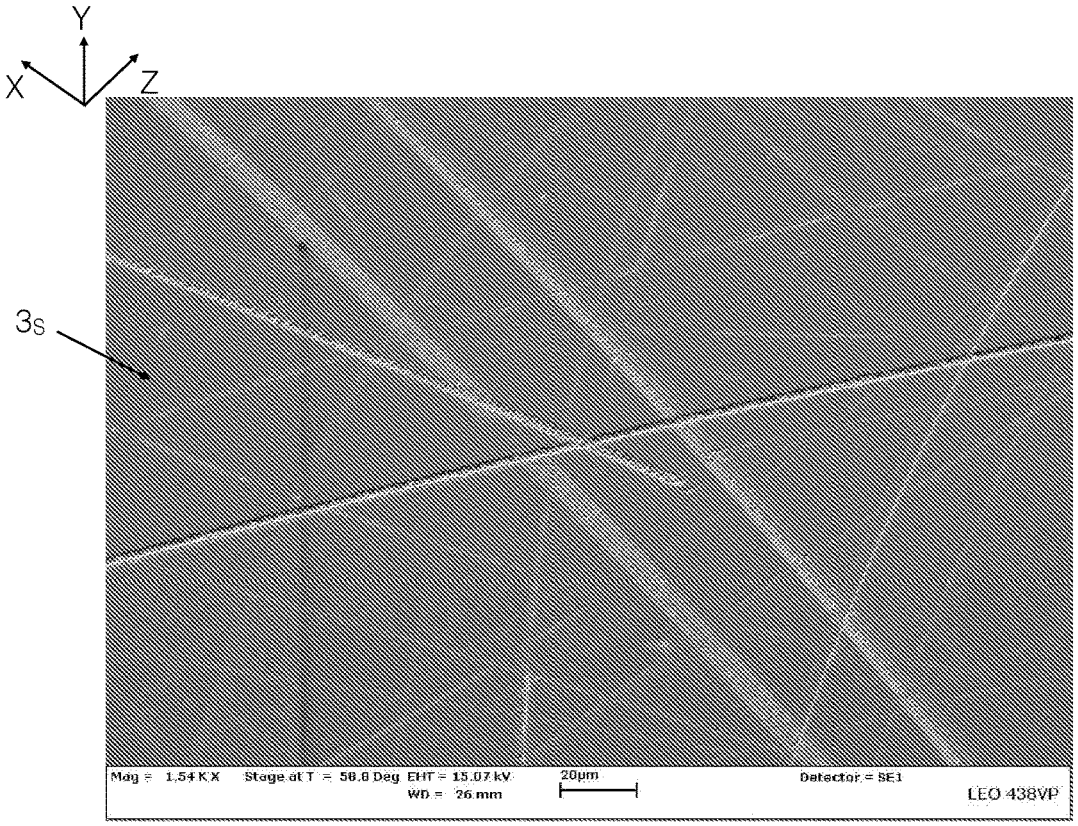
FIG. 6*a* illustrates, with a scanning electron microscope image, an abrading result with a conventional method after 10 seconds of abrading a virgin glass surface as illustrated in FIG. 6*c*, as viewed from diagonally above.
Figure 6B:
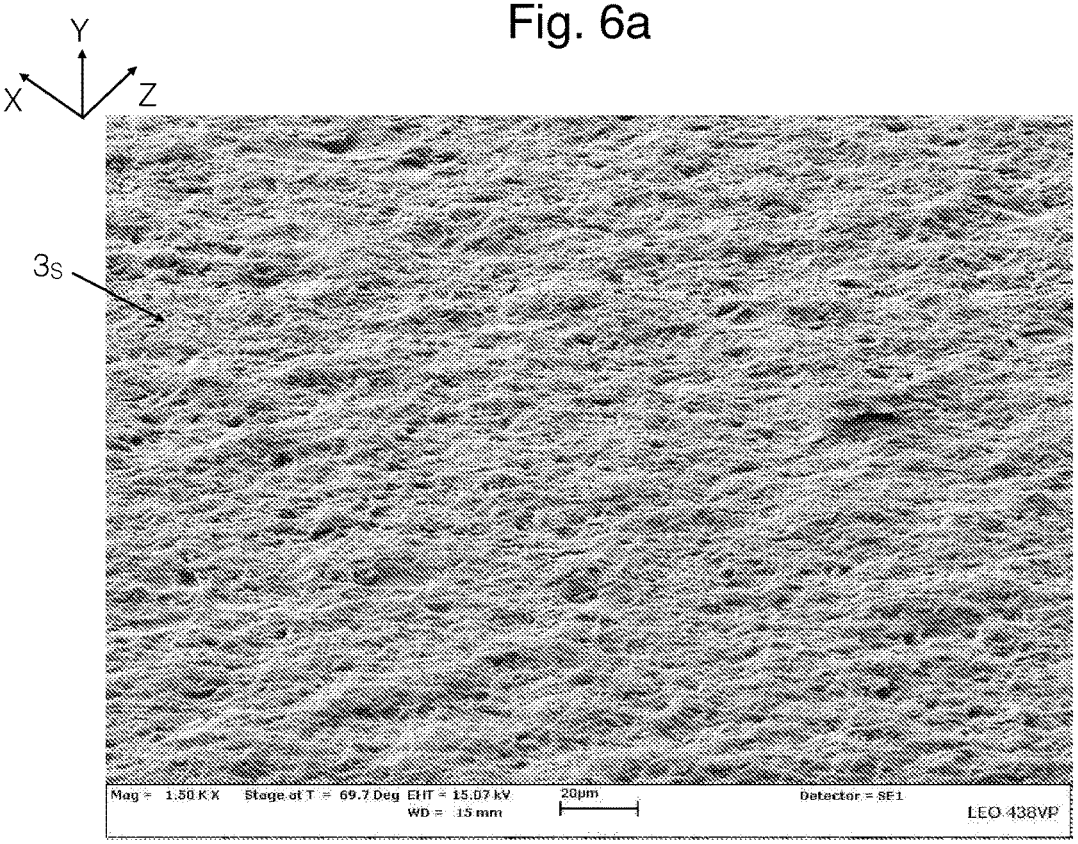
FIG. 6*b* illustrates, with a scanning electron microscope image, an abrading result with an example of the abrading method according to the disclosed solution after 10 seconds of abrading a virgin glass surface as illustrated in FIG. 6*c*, as viewed from diagonally above.

Such pressing- and rolling-like—i.e. chipping—interaction of the abrasive grains 1 with the surface $3_S$ of the workpiece 3 in comparison with a conventional abrasive article with rigidly fixed abrasive particles is illustrated in a comparative manner in FIGS. 6*a* (conventional abrasive article) and 6*b* (disclosed solution), wherein FIGS. 6*a* and 6*b* have the same magnification.

Figure 6C:
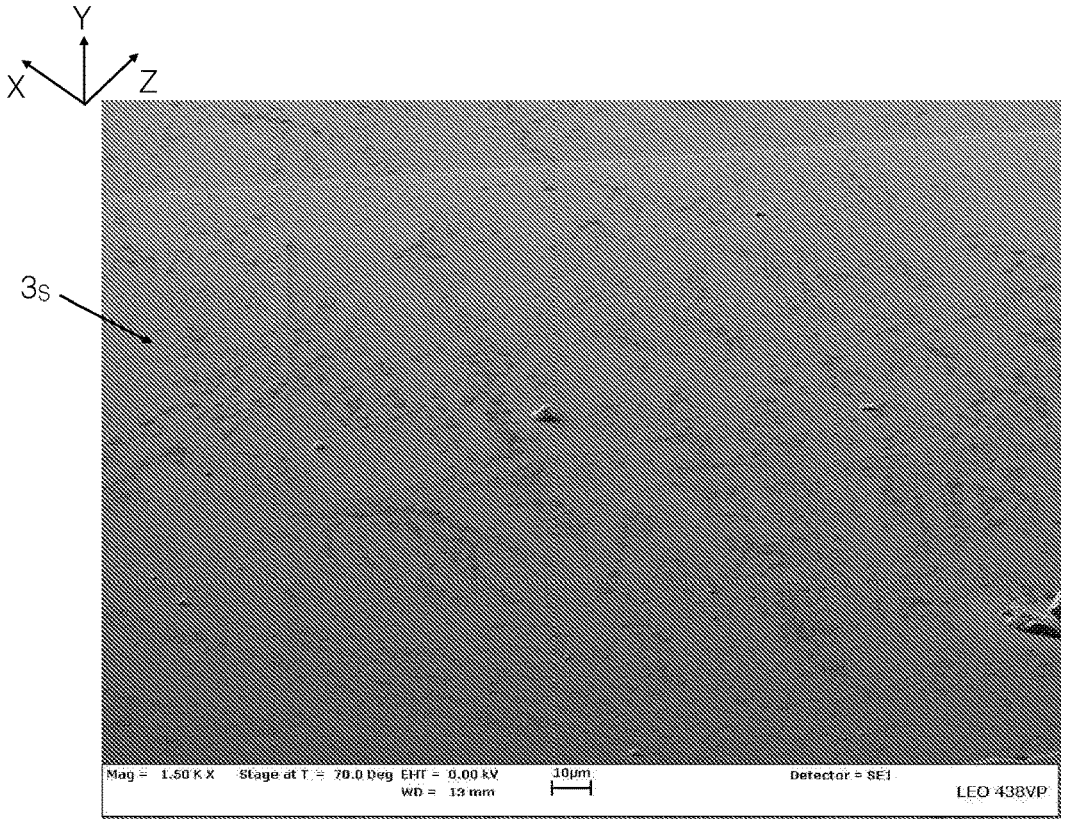
FIG. 6*c* illustrates, with a scanning electron microscope image, a virgin glass surface prior to abrading, as viewed from diagonally above.

FIG. 6*a* presents a scanning electron microscope (SEM) image of an abrading result with a conventional abrading method with rigidly fixed abrasive particles, after 10 seconds of abrading a virgin Dragontrail™ glass surface $3_S$ as illustrated in FIG. 6*c*, as viewed from diagonally above. The abrading apparatus 14 used for abrading is of the random orbital type, the vertical 30 force $F_V$ is 1.25 N/cm$^2$, the abrading is performed in the presence of water, and the abrading article is a conventional abrading disc with rigidly fixed abrasive particles.

FIG. 6*b* presents a scanning electron microscope (SEM) image of an abrading result with the abrading method according to the disclosed solution after 10 seconds of abrading a virgin Dragontrail™ glass surface $3_S$ as illustrated in FIG. 6*c*, as viewed from diagonally above. The workpiece-facing layer 21 of the abrading plate 2 is copper, the abrasive grains 1 are silicon carbide grains with an average height $h_1$ of 15 μm and the abrading apparatus 14 used for abrading is of the random orbital type and is the same abrading apparatus 14 as in the case of FIG. 6*a*. The vertical force $F_V$ is 1.25 N/cm$^2$ and the abrading is performed in the presence of slurry 4 comprising water and additives as described above.

As can be observed by comparing FIGS. 6*a* and 6*b*, the disclosed solution chips the surface $3_S$ of the workpiece 3—in the illustrated case Dragontrail™ glass—whereas abrading with a conventional abrasive article with rigidly fixed abrasive grains scratches the surface $3_S$ of the workpiece 3.

Figure 6D:
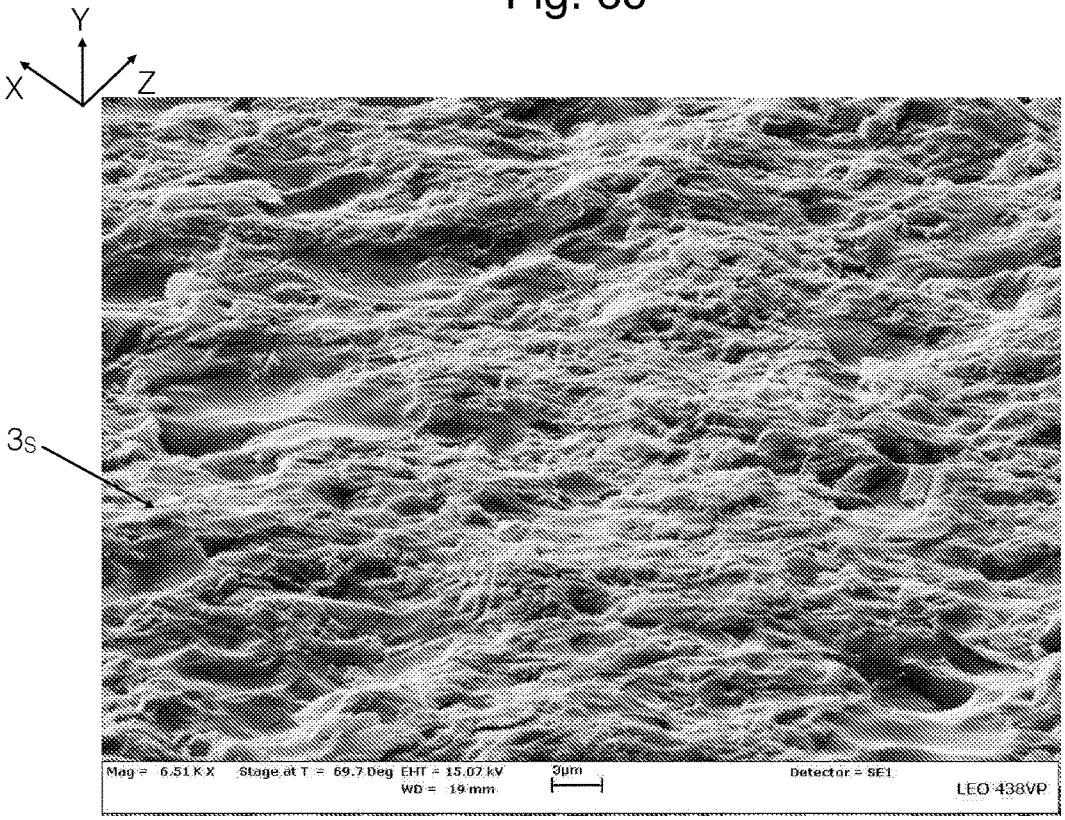
FIG. 6*d* illustrates, with a scanning electron microscope image, the abrading result of FIG. 6*b* with greater magnification, as viewed from diagonally above.

Such chipping of the surface $3_S$ of the workpiece 3 by the disclosed solution can be evidenced with greater clarity in FIG. 6*d*, which presents the surface $3_S$ of the workpiece 3 illustrated in FIG. 6*b* with greater magnification, and wherein the chipped surface $3_S$ of the workpiece 3 is clearly visible.

Furthermore, as can also be observed by comparing FIGS. 6*a* and 6*b*, the disclosed solution abrades the surface $3_S$ of the workpiece 3—in the illustrated case Dragontrail™ glass—significantly more during the same abrading time than with a conventional abrasive article with rigidly fixed abrasive grains. Therefore, the disclosed solution is, with respect to abrading, i.e. removing material from, the surface $\mathbf{3}_S$ of the workpiece 3, significantly faster than the conventional method based on an abrasive article with rigidly fixed abrasive grains.

Further still, as also can be observed by comparing FIGS. 6*a* and 6*b*, the disclosed solution produces a more uniform surface $\mathbf{3}_S$ for the workpiece 3 devoid of distinctive scratches—in the illustrated case Dragontrail™ glass—than the conventional method based on an abrasive article with rigidly fixed abrasive grains. Therefore, the surface $\mathbf{3}_S$ of the workpiece 3 after treatment with the disclosed solution is easier to polish than after treatment with a conventional method based on an abrasive article with rigidly fixed abrasive grains.

Such above-mentioned benefits of the disclosed solution stem from the properties of the abrading plate 2, and especially its workpiece-facing layer 21, as disclosed above and the consequent interaction between the surface $\mathbf{2}_S$ of the abrading plate 2, the abrasive grains 1 and the surface $\mathbf{3}_S$ of the workpiece 3—including the budging behavior of the abrasive grains 1, as described above.

Furthermore, because of the above-mentioned interaction of the abrasive grains 1 with the surface $\mathbf{2}_S$ of the abrading plate 2 and the surface $\mathbf{3}_S$ of the workpiece 3, with the disclosed solution it is possible to use abundantly available and affordable abrasive grains 1 such as silicon carbide grains, and do so without a need to attach or fix the abrasive grains 1 on the surface of an abrasive article before abrading.

An abrading pad, for example an abrading plate or a workpiece-facing layer of it, may comprise different surface patterns. Patterns may include spider web formations, spiral patterns, phyllotactic and/or any controlled non-uniform rotational pattern around the center of the pad. This may enable a more dynamic and uniform abrading process.

The above-described examples are intended to explain the general idea of the disclosed solution. Therefore, such examples are not to be taken as exhausting the ways in which the general idea of the disclosed solution may be implemented.

The invention claimed is:

1. A method of abrading a surface of a workpiece, comprising:

providing the workpiece, an abrading apparatus comprising a flexible backing pad configured to receive an abrading plate, the abrading plate attachable to the flexible backing pad and a slurry comprising abrasive grains;

attaching the abrading plate to the flexible backing pad;

providing the slurry comprising the abrasive grains between the abrading plate and the surface of the workpiece; and operating the abrading apparatus to abrade the surface of the workpiece; wherein the abrading plate comprises a workpiece-facing layer, which workpiece-facing layer faces the surface of the workpiece and consists of a metal, the abrasive grains have a hardness on Mohs scale of greater than 5, the abrasive grains have an average height of 3 to 50 μm, wherein the abrasive grains of the slurry are entrapped within the surface of the abrading plate, the abrading apparatus is of a random orbital type, an oscillation diameter of the abrading apparatus is in a range of 1 to 10 mm, and the entrapped abrasive grains travel along a random orbital path with respect to the surface of the workpiece.

2. The method according to claim 1, wherein the workpiece-facing layer has a height of 10-100 μm.

3. The method according to claim 1, wherein the workpiece-facing layer consists of a soft metal.

4. The method according to claim 1, wherein the workpiece-facing layer consists of copper.

5. The method according to claim 1, wherein the workpiece-facing layer consists of copper and has a height of 0.02-0.05 mm.

6. The method according to claim 1, wherein the abrasive grains comprise silicon carbide, aluminum oxide, boron carbide, cubic boron nitride, tungsten carbide, diamond, and/or zirconia.

7. The method according to claim 1, wherein the abrasive grains are silicon carbide grains.

8. The method according to claim 1, wherein the slurry comprises water, abrasive grains, emulsifiers, pH modifiers, wax, surface tension modifiers, oil, solvents, glycerin and/or viscosity modifiers, such that the abrasive grains account for 10-40% of the slurry and the other components account for 90-60% of the slurry.

9. The method according to claim 1, wherein the flexible backing pad comprises a rubber, polyurethane and/or latex and has a flexibility of 10-40 on Shore A hardness scale.

10. The method according to claim 1, wherein the surface of the workpiece comprises hardened glass.

11. The method according to claim 1, wherein the surface of the workpiece consists of hardened glass.

12. The method according to claim 1, wherein the surface of the workpiece comprises chemically treated glass.

13. The method according to claim 1, wherein only a portion of a total surface area of the surface of the workpiece is abraded, with a rest of the total surface area of the surface of the workpiece left non-abraded.

14. The method according to claim 1, further comprising:

polishing the abraded surface of the workpiece by using a polishing device and a polishing slurry.

15. The method according to claim 1, wherein the abrasive grains penetrate, as effected by a vertical force with which, the abrading plate is pressed against the workpiece, into differing depths of penetration into the workpiece-facing layer of the abrading plate.

16. The method according to claim 1 to recondition a glass surface comprising scratches and/or defects.

17. The method according to claim 1 to recondition a glass panel of an electronic device which glass panel comprises scratches and/or defects.

18. The method according to claim 1, wherein an oscillation frequency of the abrading apparatus is in the range of 1000 to 18000 oscillations per minute.

* * * * *